US009835301B2

(12) United States Patent
Sorensen et al.

(10) Patent No.: US 9,835,301 B2
(45) Date of Patent: Dec. 5, 2017

(54) OPTICAL SYSTEMS AND METHODS FOR POLE LUMINAIRES

(71) Applicant: ABL IP HOLDING LLC, Conyers, GA (US)

(72) Inventors: Christopher J. Sorensen, Denver, CO (US); Christopher D. Slaughter, Denver, CO (US); Carl T. Gould, Golden, CO (US); Peter K. Nelson, Denver, CO (US); Kevin F. Leadford, Evergreen, CO (US)

(73) Assignee: ABL IP Holding LLC, Atlanta, GA (US)

( * ) Notice: Subject to any disclaimer, the term of this patent is extended or adjusted under 35 U.S.C. 154(b) by 225 days.

(21) Appl. No.: 14/789,131

(22) Filed: Jul. 1, 2015

(65) Prior Publication Data

US 2016/0003432 A1 Jan. 7, 2016

Related U.S. Application Data

(60) Provisional application No. 62/019,747, filed on Jul. 1, 2014.

(51) Int. Cl.
*F21S 8/08* (2006.01)
*F21W 131/10* (2006.01)

(52) U.S. Cl.
CPC ..... *F21S 8/083* (2013.01); *F21W 2131/10* (2013.01)

(58) Field of Classification Search
CPC ..... F21S 8/083; F21W 2131/10
See application file for complete search history.

(56) References Cited

U.S. PATENT DOCUMENTS

| | | | | |
|---|---|---|---|---|
| D60,735 | S | 3/1922 | Rogers | |
| D85,688 | S | 12/1931 | DeVos | |
| D118,615 | S | 1/1940 | Chapman | |
| D209,416 | S | 11/1967 | Smith | |
| 3,533,062 | A * | 10/1970 | Coffman | G08G 1/095 340/907 |
| D234,809 | S | 4/1975 | Delin | |
| D236,151 | S | 7/1975 | Friedberg | |
| 4,438,484 | A | 3/1984 | Winden | |
| D360,048 | S | 7/1995 | Messina, Jr. | |
| D361,150 | S | 8/1995 | Messina, Jr. | |
| D362,737 | S | 9/1995 | Messina, Jr. | |
| 5,479,322 | A | 12/1995 | Kacheria | |
| D372,320 | S | 7/1996 | Brady | |
| D382,910 | S | 8/1997 | Greenfield | |
| D388,900 | S | 1/1998 | Metchear, III | |
| D393,089 | S | 3/1998 | Metchear, III | |
| D425,173 | S | 5/2000 | Landefeld | |
| D439,000 | S | 3/2001 | Landefeld | |

(Continued)

*Primary Examiner* — Mary Ellen Bowman
(74) *Attorney, Agent, or Firm* — Kilpatrick Townsend & Stockton, LLP

(57) ABSTRACT

A pole luminaire mounts to a base and illuminates an area adjacent to the base. The luminaire includes a core structure having a plurality of side portions that extend vertically from the base, disposed about an elongate, open central shaft. One or more luminaire subassemblies couple with the core structure. Each luminaire subassembly includes a housing with a face panel that defines an aperture, a face plate coupled within the aperture, and a light engine having one or more light emitters. Light is directed through the aperture and the face plate into the area.

23 Claims, 11 Drawing Sheets

(56) References Cited

U.S. PATENT DOCUMENTS

| | | | | |
|---|---|---|---|---|
| 6,457,847 | B1 | 10/2002 | LeVasseur | |
| 6,530,675 | B1 * | 3/2003 | Van Etten | F21S 8/083 362/153.1 |
| D529,217 | S | 9/2006 | Wood | |
| D530,442 | S | 10/2006 | Wen | |
| D541,461 | S | 4/2007 | Flaherty | |
| D553,286 | S | 10/2007 | Chung et al. | |
| 7,434,964 | B1 * | 10/2008 | Zheng | F21V 29/006 362/218 |
| D592,783 | S | 5/2009 | Flaherty et al. | |
| D598,152 | S | 8/2009 | Tortel | |
| D598,597 | S * | 8/2009 | Lu | D26/68 |
| 7,810,968 | B1 * | 10/2010 | Walker | F21S 8/08 362/218 |
| D640,407 | S * | 6/2011 | Chen | D26/67 |
| D663,459 | S | 7/2012 | Wauters | |
| D676,588 | S | 2/2013 | Nankil | |
| D678,578 | S | 3/2013 | Wauters | |
| D679,436 | S | 4/2013 | Gismondi | |
| D696,796 | S | 12/2013 | Macura et al. | |
| D696,805 | S | 12/2013 | Duquette et al. | |
| D719,287 | S * | 12/2014 | Sorensen | D26/68 |
| D719,288 | S | 12/2014 | Sorensen et al. | |
| D719,289 | S | 12/2014 | Sorensen et al. | |
| D721,197 | S | 1/2015 | Sorensen et al. | |
| 9,239,151 | B2 * | 1/2016 | Mikami | F21V 29/74 |
| 2005/0110649 | A1 * | 5/2005 | Fredericks | B64D 47/06 340/815.45 |
| 2008/0130299 | A1 * | 6/2008 | Dorogi | F21V 29/004 362/373 |
| 2008/0273333 | A1 * | 11/2008 | Berns | F21S 8/083 362/294 |
| 2009/0040750 | A1 * | 2/2009 | Myer | F21S 8/083 362/183 |
| 2012/0206910 | A1 * | 8/2012 | Watson | F21V 31/005 362/218 |

* cited by examiner

FIG. 8A
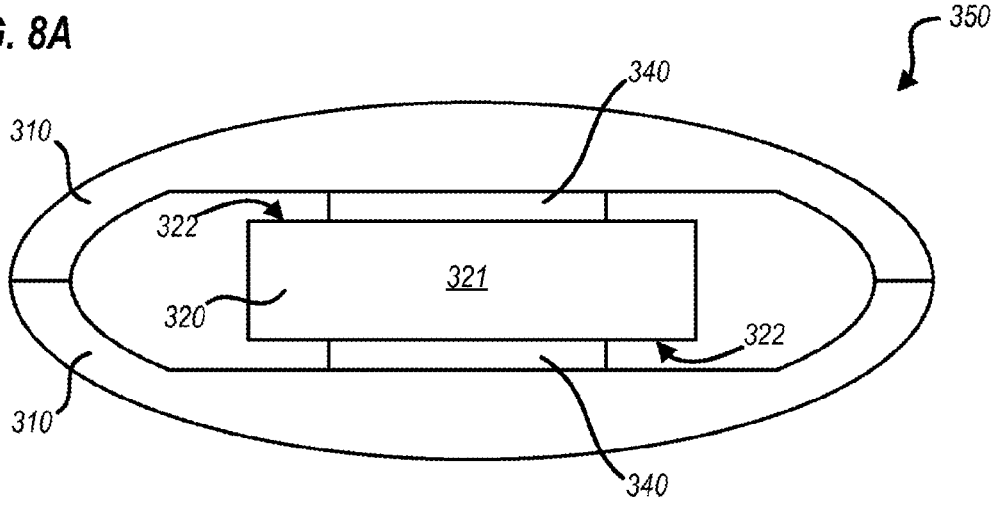
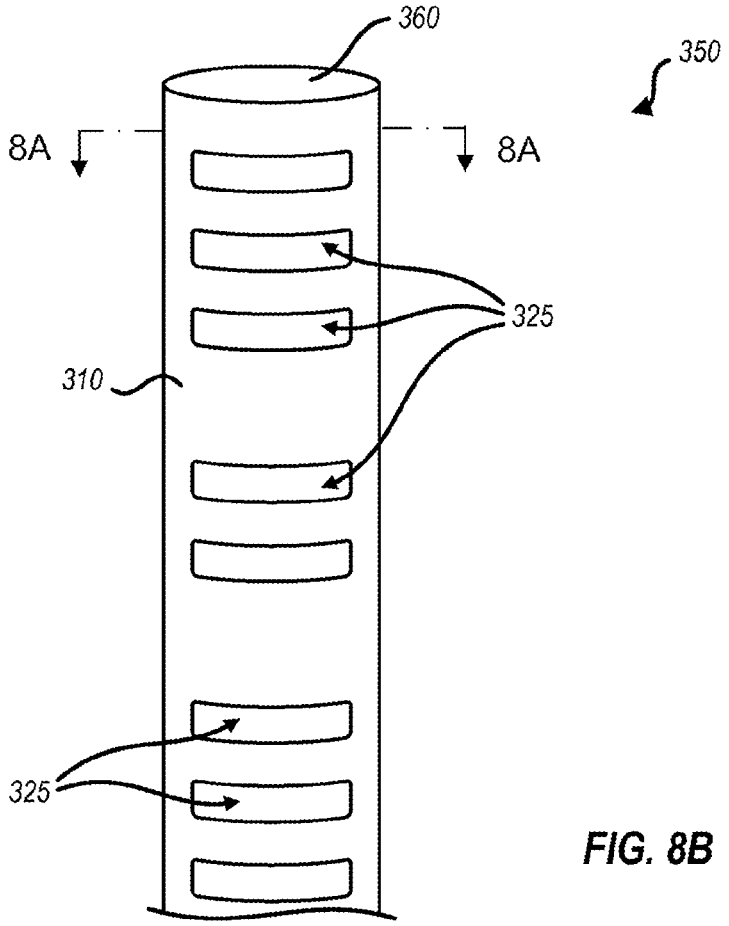
FIG. 8B

OPTICAL SYSTEMS AND METHODS FOR POLE LUMINAIRES

CROSS-REFERENCE TO RELATED APPLICATIONS

This application claims the benefit of U.S. Provisional Patent Application No. 62/019,747 filed Jul. 1, 2014, which is incorporated by reference herein.

BACKGROUND

Luminaires for outdoor lighting are often designed for aesthetic appeal of the equipment when it is directly viewed, as well as for providing high quality illumination. Certain pole mounted luminaires position a light emitter such that light emits through an aperture covered by a lens or screen that protects the light emitter, but does not enhance the aesthetics of the aperture as seen by a viewer. Also, the reverse is sometimes true for a pole light, that is, the aperture looks nice but there is very little in the way of a photometric distribution (i.e., the pole luminaire is a rather dimly lit "marker light.")

SUMMARY in an embodiment, a pole luminaire is configured for mounting to a base and for illuminating an area adjacent to the base. The pole luminaire includes a core structure, that in turn includes a plurality of substantially vertical side portions that are configured to couple with and extend vertically from the base. The substantially vertical side portions are disposed about an elongate, open central shaft. The luminaire also includes one or more luminaire subassemblies that couple with the core structure. Each luminaire subassembly includes a housing having a face panel, wherein an aperture is defined in the face panel and comprises a height and a width. A face plate coupled within the aperture. Each luminaire subassembly also includes a light engine including one or more light emitters, wherein light emitted by the one or more light emitters is directed through the aperture and the face plate into the area.

In an embodiment, a pole luminaire illuminates an illuminated area, and includes a base, a core structure mounted with and extending vertically from the base, and one or more power supplies within the core structure. A plurality of subassemblies couple with the core structure so as to prevent visibility of the core structure from any side. At least one of the subassemblies is a luminaire subassembly that includes a face panel having a length along the core structure, and defining one or more apertures therein, and a rear panel. Associated with each of the one or more apertures, is a horizontal row of light emitters, a diffuser, a reflector, a face plate and a rear shell. The horizontal row of light emitters is disposed within an interior space between the face panel and the rear panel. The light emitters are disposed adjacent to an inner surface of the face panel along an upper edge of the aperture, and are oriented to emit light toward the interior space. The diffuser is disposed within the interior space such that substantially all of the light from the light emitters impinges on the diffuser and is diffused. The reflector has a shape that is concave with respect to the aperture and the illuminated area, such that the light from the diffuser is reflected toward the aperture. The face plate is coupled within the aperture such that the light passes through the aperture at the face plate after it is reflected by the reflector.

The rear shell is coupled with the face panel, and encloses at least the light emitters, the diffuser and the reflector within the interior space.

BRIEF DESCRIPTION OF THE DRAWINGS

Embodiments are described in detail below with reference to the following figures, in which like numerals within the drawings and mentioned herein represent substantially identical structural elements.

FIGS. 8A and 8B schematically illustrate a pole luminaire having two curving outer faces, according to an embodiment.

DETAILED DESCRIPTION

The subject matter of embodiments of the present invention is described here with specificity to meet statutory requirements, but this description is not intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Each example is provided by way of explanation, and not as a limitation. For instance, features illustrated or described as part of one embodiment may be used on another embodiment to yield a further embodiment. Thus, it is intended that this disclosure includes modifications and variations.

Pole luminaires, and optical systems and methods used in such pole luminaires are disclosed according to various embodiments. These luminaires, systems and methods generally provide lighting generated by light emitters, shaped by optics and emitted through apertures in a pole shaped housing.

Figure 1:
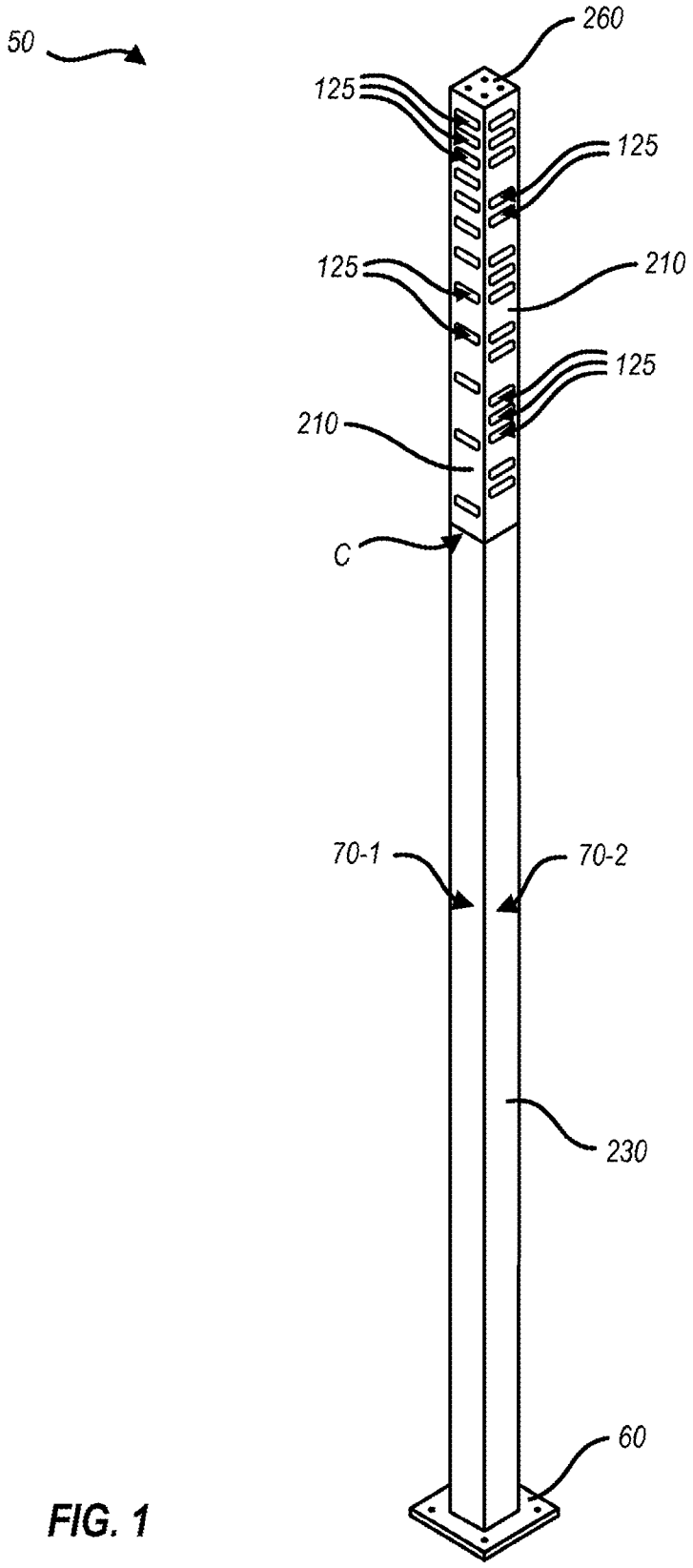
FIG. 1 is an isometric view of a pole luminaire, according to an embodiment.

FIG. 1 is an isometric view of a pole luminaire 50, according to an embodiment. Pole luminaire 50 mounts on a base 60 and presents four sides 70; sides 70-1 and 70-2 are labeled in FIG. 1, while two others of the four sides are hidden from view. The number of sides 70 in pole luminaire 50 can vary from as few as two sides to any number of sides; embodiments with two, three and four sides represent especially advantageous choices in terms of balancing lighting coverage against complexity of design and manufacturing, as discussed below. Pole luminaire 50 as illustrated in FIG. 1 includes an optional base transition 230 that may be considered part of base 60, but is not included in all embodiments. Base transition 230 and other possible base transitions may advantageously provide visual continuity so that luminaire 50 presents no abrupt cross-sectional change at a transition from a structural support portion to a portion that includes luminaire subassemblies that provide light. For example, in FIG. 1, base transition 230 provides a substantially similar or identical cross-section to the portion of pole luminaire 50 at the location marked C, from which subassemblies 210 continue upward. In luminaire 50, a core structure (hidden in the view of FIG. 1) couples to base 60 through base transition 230, and includes two or more substantially vertical side portions that couple with base 60 (through base transition 230) and are arranged about an elongate, open central shaft 221. One or more luminaire subassemblies 210 couple with the core structure (see FIGS. 5A, 6A, 6B, 7A, 7B). In embodiments, subassemblies 210 couple with the core structure and are disposed adjacent to one another so as to prevent visibility of and/or access to the core structure from any side, as also described further below.

Figure 5A:
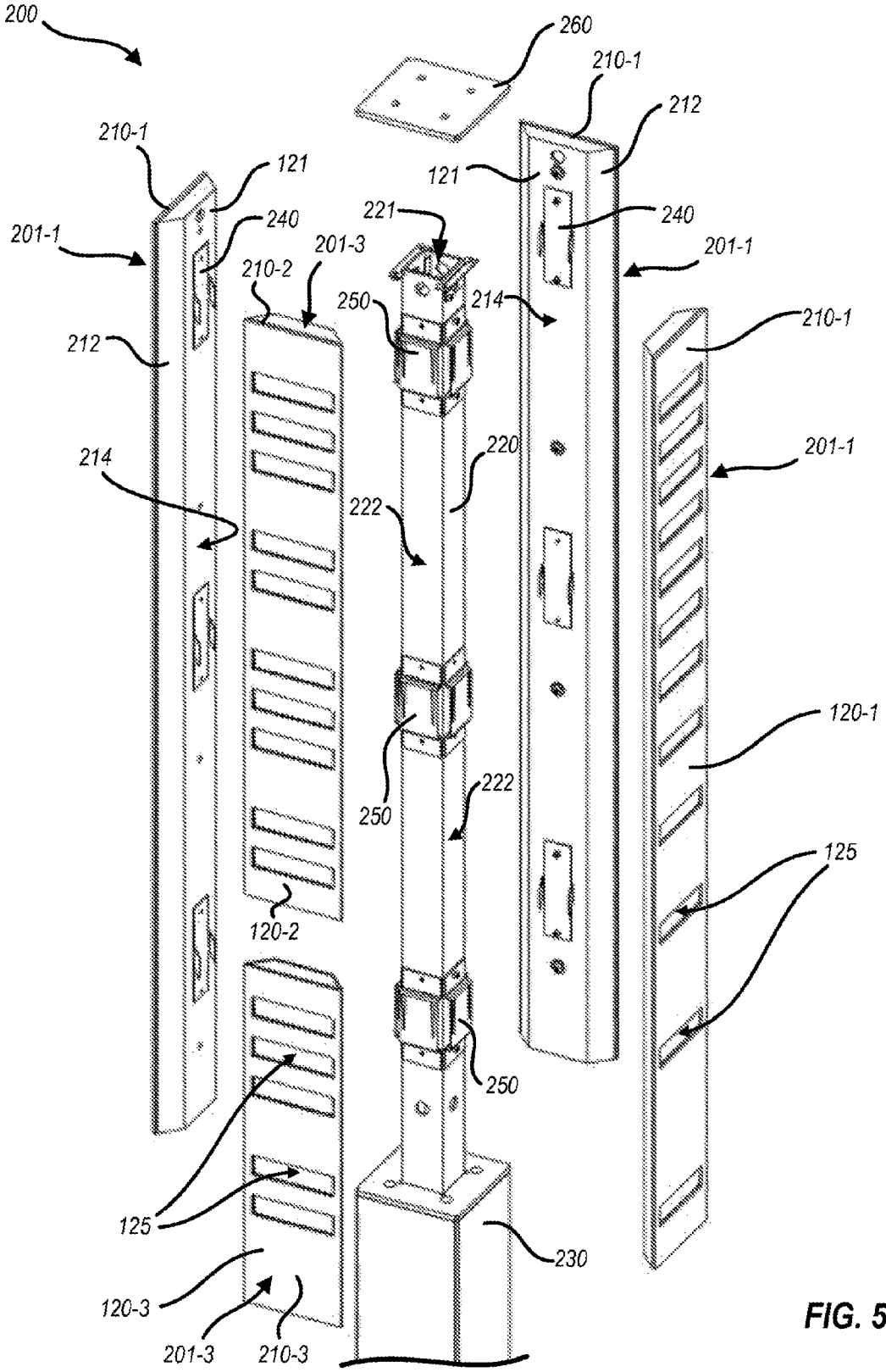
FIG. 5A is a schematic exploded diagram of components of a portion of a pole luminaire, according to an embodiment.
Figure 5B:
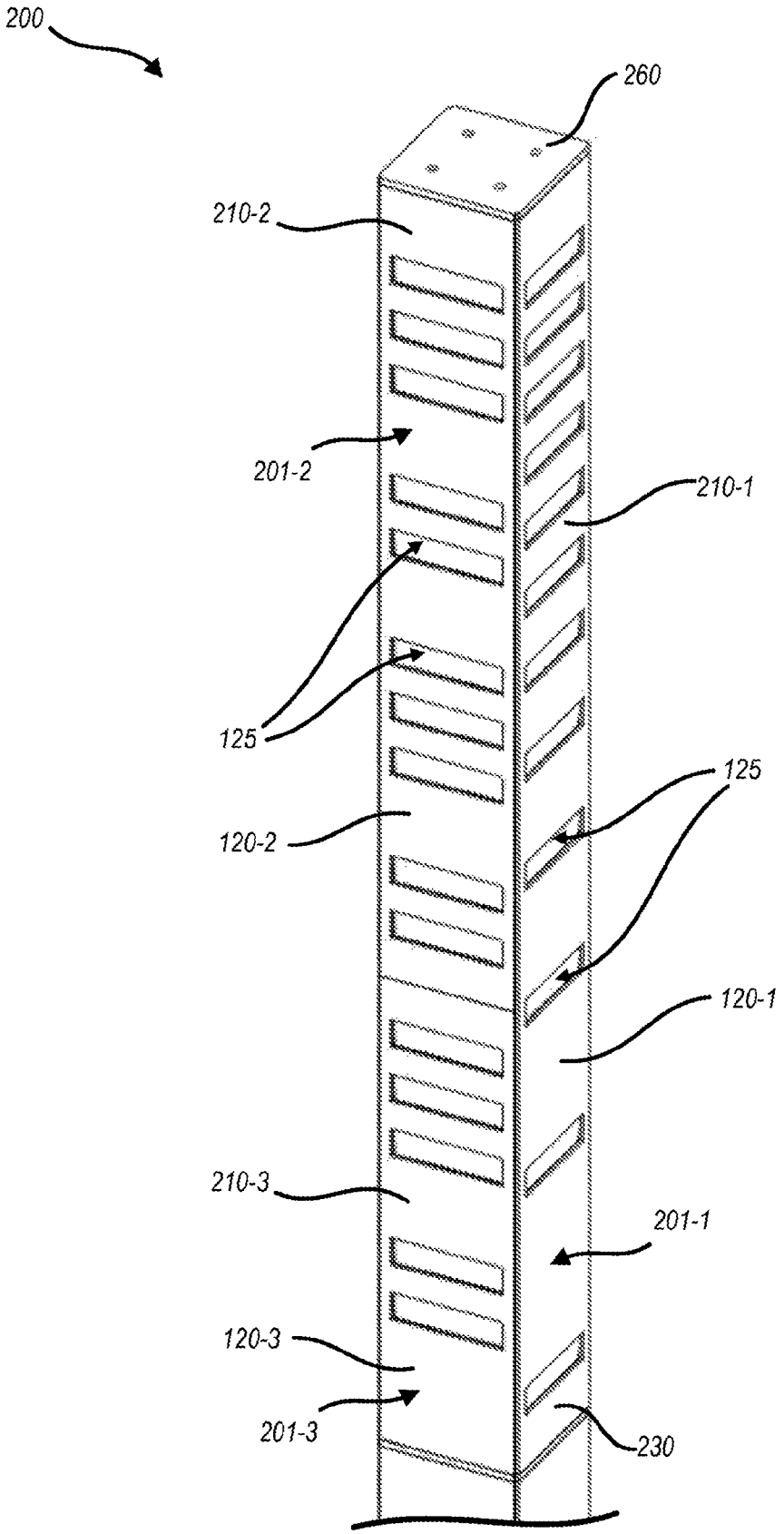
FIG. 5B illustrates the portion of the pole luminaire of FIG. 5A, fully assembled.

FIG. 5A is a schematic exploded diagram of components of portions of a pole luminaire 200, according to an embodiment. FIG. 5B illustrates the portion of pole luminaire 200 that is shown in exploded form in FIG. 5A, fully assembled. FIG. 5A schematically illustrates five luminaire subassemblies 210 with a core structure 220 that includes vertical side portions 222, as shown. Three of the luminaire subassemblies are designated as 210-1; one instance each of luminaire subassemblies 210-2 and 210-3 are also present. As shown in FIG. 5A, core structure 220 may couple with, and extend vertically from a base (not shown), via a base transition 230. (As noted above, in other embodiments, core structure 220 may couple directly with a base, such as base 60, FIG. 1). Core structure 220 may for example provide a convenient and protected location in which to locate power supplies, driver circuitry, wiring and the like for subassemblies 210. Each subassembly 210 includes a housing 201 formed by a face panel 120 having apertures 125 therein, and a rear shell 214 that includes a rear panel. 121 and sides 212. Subassemblies 210 enclose one or more of-light engines 100 (FIGS. 2-3) that project light through the apertures 125 (only a few apertures 125 are labeled in FIG. 5A).

Figure 2:
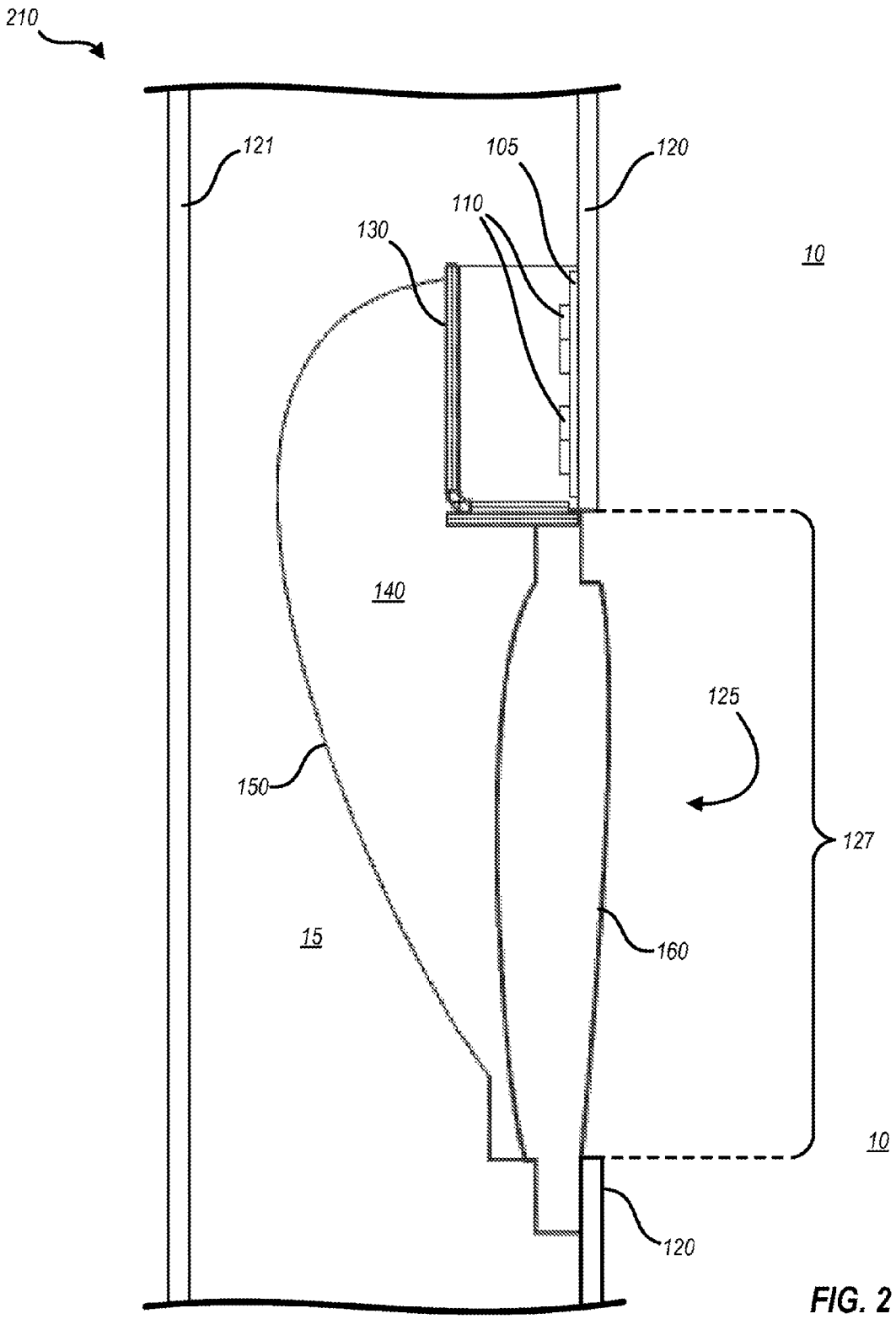
FIG. 2 is a schematic cross-section of an optical system for a pole luminaire, according to an embodiment.

FIG. 2 is a schematic cross-section of a portion of a luminaire subassembly 210 for a pole luminaire, and illustrating a light engine 100 therein, according to an embodiment. Subassembly 210 illuminates an adjacent illuminated area 10 with at least one light engine 100 housed within the subassembly 210. Face panel 120 and rear panel 121 of luminaire subassembly 210 define an interior space 15. Face panel 120 forms one or more apertures 125 that connect between interior space 15 and illuminated area 10. Aperture 125 has a width (pot shown in the view of FIG. 2, see FIG. 4) and a height 127; in certain embodiments the horizontal extent is larger than the vertical extent, but this is not required. Any number of apertures 125 may be provided along the height of the subassembly 210.

At least one light engine 100 is provided within the subassembly 210 to emit light through the aperture(s) 125. Typically, a separate light engine 100 will be provided for each aperture 125 of the subassembly 210, but that may not always be the case. Rather, the subassembly 210 may include apertures through which no light is emitted, or light from one light engine 100 may be directed through multiple apertures 125.

Light engine 100 includes at least one row of light emitters 110 that may be, for example, discrete light emitting diodes (LEDs) or "chip on board" type light emitters. The embodiment shown in FIG. 2 has two horizontal rows of light emitters 110 coupled with a PCB 105, but more or fewer rows of light emitters, and different orientations of rows or staggered arrangements (e.g., zigzags) thereof may be present in embodiments. Light from light emitters 110 is initially directed within housing 201 toward rear panel 121, and in embodiments is diffused by a diffuser 130. In embodiments, diffuser 130 may include a phosphor. The light exits into an optical chamber 140 bounded by a reflector 150 and a face plate 160 positioned within aperture 125. Reflector 150 redirects the light toward face plate 160 (see also FIG. 3) such that the light emits through aperture 125 and face plate 160. In embodiments, face plate 160 may be a flat, translucent or transparent plate; in other embodiments, face plate 160 is a refractive optical element that further redirects the light as it exits light engine 100 into illuminated area 10. Although face plate 160 may not be perfectly transparent (e.g., it may introduce some incidental scatter) high transparency of face plate 160 is advantageous so that output direction of light directed thereto can be controlled.

The configuration of light emitters 110 within light engine 100 confers certain advantages for a pole luminaire. By forcing all of the emitted light through diffuser 130, through one or more reflections off of reflector 150 and optionally through refractions and/or reflections within face plate 160, the emitted light is mixed such that a viewer never perceives the light emitters themselves as individual point sources, but rather perceives the aperture as having a uniform brightness across its length and width. Also, given that reflections and optical path length are advantageous in terms of mixing the light, orienting light emitters 110 so that they emit rearwardly allows "folding" of the optical path such that depth of light engine 100 is minimized, leaving room within the pole luminaire for a core structure (described below) to provide structural support and passages for electrical wiring, driver circuits and the like. Furthermore, the rearwardly-emitting orientation of light emitters 110 allows PCB 105 to mount in thermal communication with face panel 120 so that heat generated by light emitters 110 has a very short external heat dissipation path through face panel 120.

Figure 3:
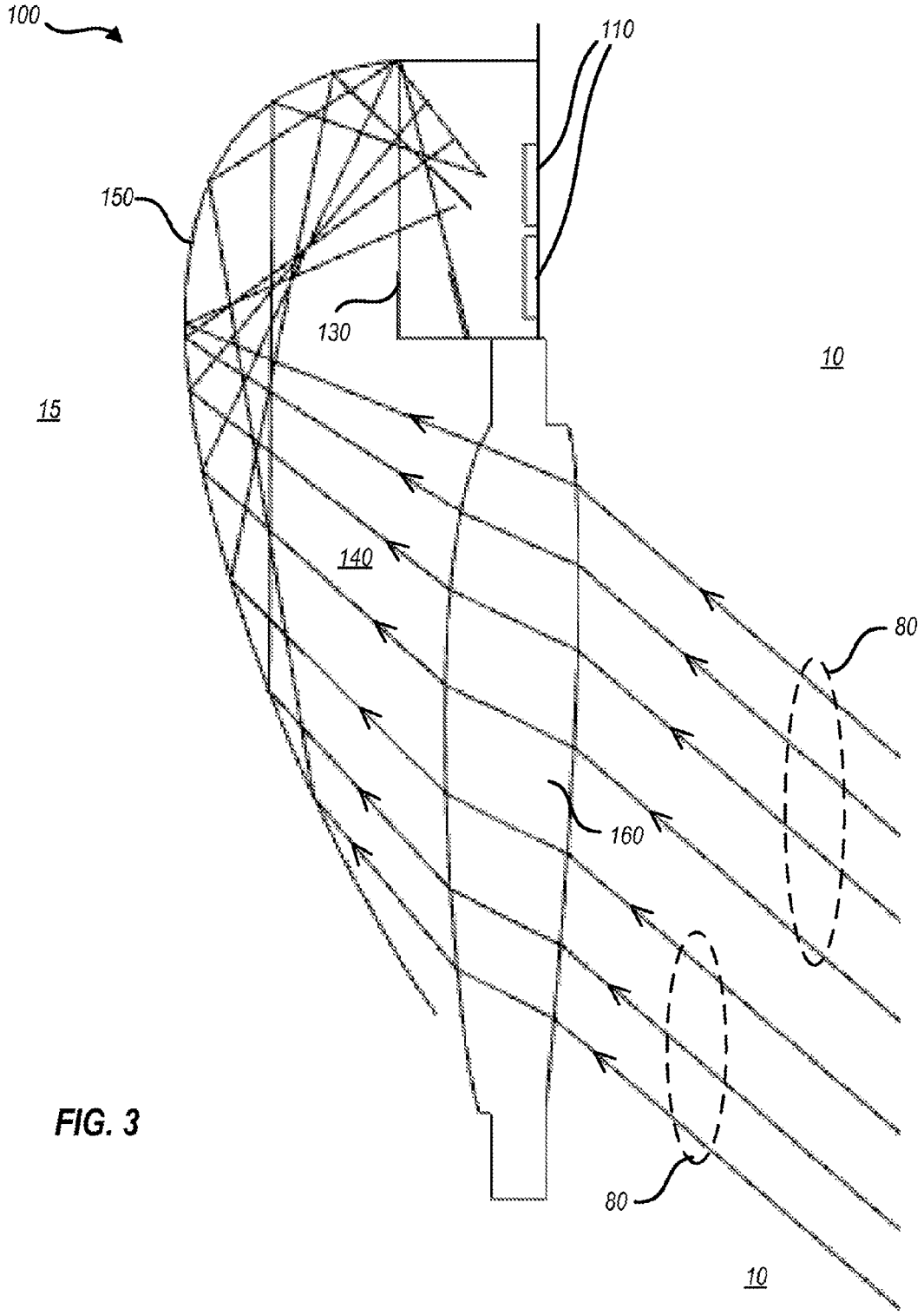
FIG. 3 is a schematic ray trace diagram showing selected components of the optical system of FIG. 2.

FIG. 3 is a schematic ray trace diagram showing selected components of light engine 100, FIG. 2. Rays 80 of FIG. 3 are traced backwards, that is, FIG. 3 shows that rays entering face plate 160 along the upward paths shown, will reflect one or more times from reflector 150 and arrive at diffuser 130. The reason for backwards ray tracing is to determine what an observer at a given angle will perceive when looking at aperture 125 (FIG. 2) or one or more points thereof. FIG. 3 shows that light engine 100 will provide a uniform perception of luminance from bottom to top of aperture 125 to an observer who looks at aperture 125 from the angle shown, not a combination of some luminance and a view of (non-illuminated) components within light engine 100, or a reflected view of objects outside light engine 100. The combined shaping of reflector 150 and faceplate 160 provide this same treatment of backwards rays, and therefore visual experience, within an angular zone ranging from about 20 degrees to about 90 degrees below horizontal. Conversely, the shaping of reflector 150 and faceplate 160 are also such that backwards rays coming from a zone about 10 degrees below horizontal to anywhere above horizontal—an angular zone being associated with higher potential for glare, light trespass and light pollution—do not trace back to diffuser 130 and/or light emitters 110. While some light is still emitted by the optical system in this zone (see FIG. 11) this is solely due to scatter from optical imperfections, internal Fresnel reflections and the like that represent a far smaller proportion of light output than that which is directed downwardly. Reflector 150 typically spans aperture 125 in both the horizontal and vertical directions. Curvature of reflector 150 may vary from that shown, but will generally be concave with respect to aperture 125 and illuminated area 10. Also, advantageously, the curve of reflector 150 will be continuous across the height of aperture 125, such that visually distracting lines that would be formed by angles in the reflector are avoided in the illumination projected into illuminated area 10 (and thus are avoided in the appearance of aperture 125 as viewed from illuminated area 10).

Figure 4:
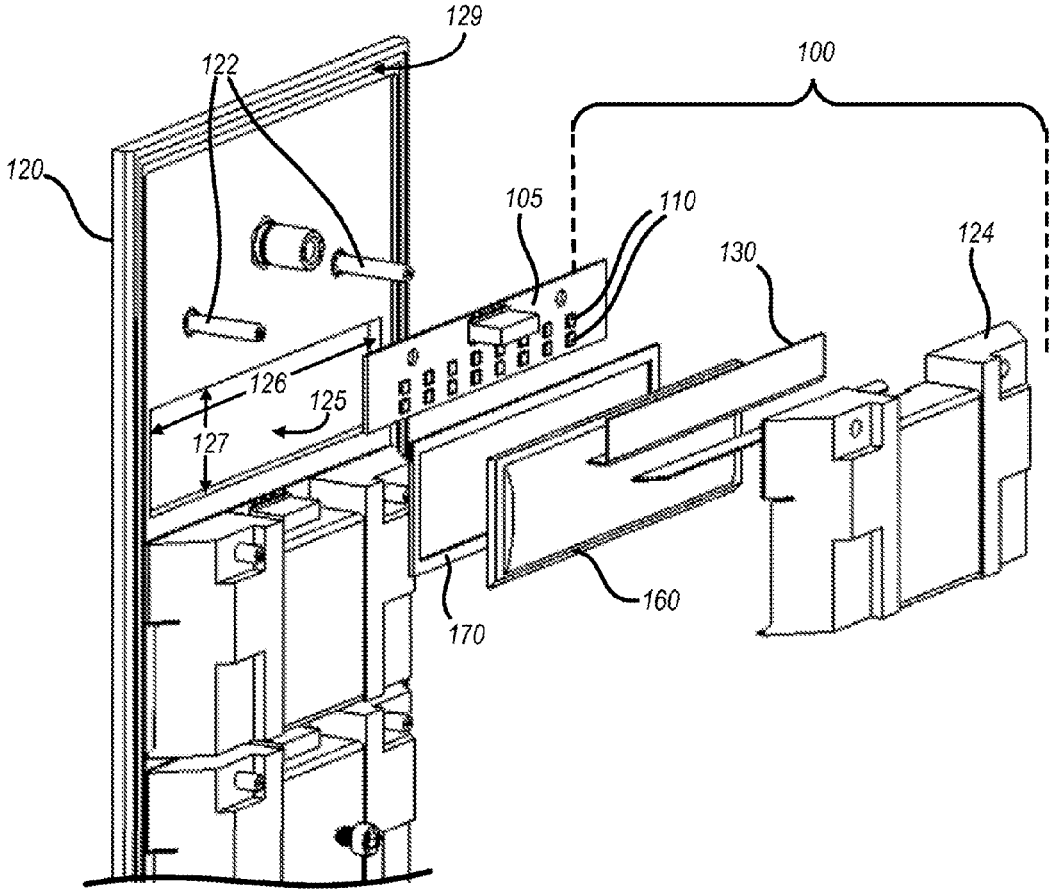
FIG. 4 is a schematic exploded diagram of selected components of the optical system of FIG. 2, and of a housing for a pole luminaire, according to an embodiment.

FIG. 4 is a schematic exploded diagram of selected components of light engine 100, FIG. 2, as well as face panel 120 and an inner housing shell 124 that encloses light engine 100 against face panel 120, according to an embodiment. In FIG. 4, both a width 126 and a height 127 of one aperture 125 are shown. Aperture 125 is shown in FIG. 4 with relatively square or sharp corners, but other embodiments may feature rounded corners. Face panel 120 includes pegs 122 that extend rearwardly from the inner surface of face panel 120 (e.g., toward rear panel 121, see FIGS. 2 and 5A) to provide mechanical support and alignment for portions of light engine 100. PCB 105 has light emitters 110 coupled thereto; apertures of PCB 105 align with pegs 122 of face panel 120 to align PCB 105 and light emitters 1110 in a known location with respect to face panel 120. Inner housing shell 124 also features apertures that align with pegs 122 to facilitate positioning, alignment and assembly of light engine 100, and to improve structural integrity of the assembled luminaire subassembly. Inner housing shell 124 encloses reflector 150 (reflector 150 is hidden in the view of FIG. 4; see FIGS. 2 and 3). An optional gasket 170 is interposed between face plate 160 and an inner surface of face panel 120 about a peripheral edge of aperture 125, sealing face plate 160 to face panel 120 to protect the elements that are between face plate 160 and inner housing shell 124. Diffuser 130 and reflector 150 may be retained by being surrounded by face panel 120 and inner housing shell 124, and/or may be affixed therein using mechanical fasteners or adhesives. The inner surface of face panel 120 may form a groove 129 that receives a gasket, against which a rear shell (e.g., rear shell 214, see FIG. 5A) can seal to face panel 120.

Subassemblies 210 are positioned around and mounted onto core structure 220 so as to enclose core structure 220 so as to prevent visibility of the core structure from any side, providing a neat and sleek appearance to the pole luminaire. For example, sides 212 of rear shell 214 may be angled relative to face panel 120 and rear panel 121 (e.g., at about or less than 45 degrees, or half of each exterior angle, 90 degrees for a four-sided pole) so that two subassemblies 210 may assemble to form a pole luminaire that is square or rectangular in plan view (that is, sides 212 will not interfere with each other at the outside corners when assembled). However, pole luminaires herein are not limited to square or rectangular pole configurations; it will be understood by those skilled in the art that the principles herein may be adapted to pole luminaires having triangular, pentagonal, hexagonal or any other type of polygonal cross-section by tapering rear shells at appropriate half-angles, or less, of corresponding exterior angles. Furthermore, faces of such luminaires may be planar, as shown herein, or may be curved, with the light emitting devices, reflectors, face plates and the like adapted accordingly (see, e.g., FIGS. 8A, 8B). Embodiments herein may be optimized to provide lighting that is strongest in one, two, three or more directions, by providing a corresponding core structure and adding luminaire subassemblies facing the directions where lighting is desired. It might not be desirable to emit light from all sides the pole luminaire. In such situations, non-illuminating subassemblies could be mounted onto the core structure 220 on such sides. Non-illuminating subassemblies are defined herein as subassemblies that do not explicitly illuminate a surrounding area, but may emit light at a low level for purposes such as to provide decorative accents or convey information. Thus, non-illuminating subassemblies may lack light engines like light engine 100, but may include other white or colored light sources, or lighted displays. When such light sources are present, they may use color or dynamic variation of light output to convey information, such as pedestrian or motor traffic controls, names of streets, paths or aisles, and the like. When such displays are present, they may operate in a similar manner to other known displays, that is, they may display images, graphics, text or any combination thereof; such displayed items may appear static or may appear to move within the display. In some embodiments, non-illuminating subassemblies provide a flat surface without apertures, while in other embodiments non-illuminating subassemblies include features resembling apertures 125 as discussed above, but without light engines 100, or with different lighted features.

Figure 6A:
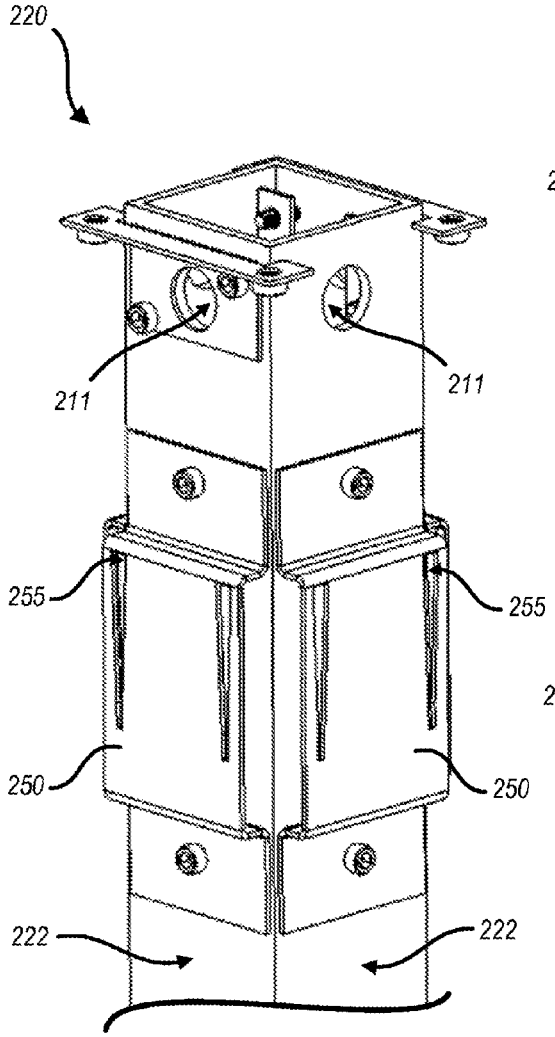
FIGS. 6A and 6B show exemplary details of the core structure of the pole luminaire of FIGS. 5A and 5B, and one subassembly thereof, according to an embodiment.
Figure 6B:
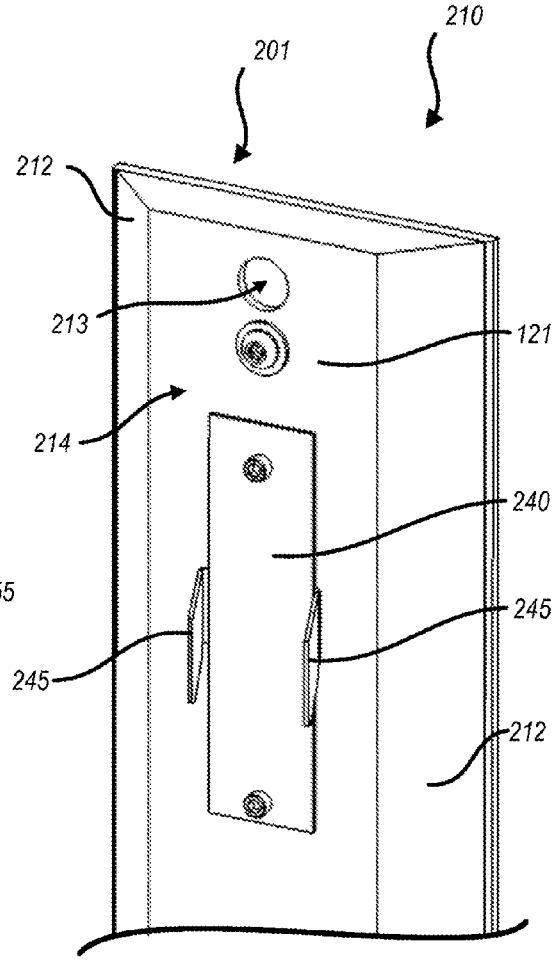

In one embodiment, subassemblies 210 attach to core structure 220 by means of a hanger bracket 240 that mates with a receiver bracket 250 (see also FIGS. 6A, 6B). Receiver brackets 250 couple with vertical side portions 222 of core structure 220 such that hanger brackets 240 can suspend luminaire and/or non-illuminating subassemblies (discussed above) thereto in vertical orientation. Hanger brackets 240 and receiver brackets 250 are but examples of many kinds of mating brackets that may be used to couple luminaire and/or non-illuminating subassemblies to core structure 220. Other forms of mating brackets, such as those in which a feature of one of the brackets is inserted within the other bracket and then slid or rotated to fix it into place, may be used. As discussed below, it may be advantageous to use a type of bracket in which gravity assists in keeping the luminaire and/or non-illuminating subassemblies in place during assembly, after which a cap or other mechanical device secures the subassemblies. It may also be advantageous to use brackets like hanger brackets 240 and receiver brackets 250, in which the brackets and their corresponding subassemblies may be positioned and then fixed in place by a further component (such as cap 260, discussed below). Although the following discussion will center on the use of hanger brackets 240 and receiver brackets 250, it should be understood that any other type(s) of mating bracket(s) may be used.

FIGS. 6A and 6B show exemplary details of core structure 220 and one subassembly 210 respectively, according to an embodiment. Core structure 220 features a receiver bracket 250 on each vertical side portion 222 upon which one or more subassemblies 210 are to be mounted; the corresponding subassemblies 210 have hanger brackets 240 that mount with receiver brackets 250. As shown in FIGS. 6A and 6B, slots 255 of receiver brackets 250 are defined at a particular spacing, and tabs 245 of hanger brackets 240 are disposed at the same spacing so that when engaged, hanger bracket 240 forms a mechanically robust, two point connection with receiver bracket 250. In other embodiments, more than two sets of slots and tabs may be present in receiver and hanger brackets. Also, in embodiments, a ramping slope of tabs 245 helps in assembling subassemblies 210 to slots 255 of receiver brackets 250, such that gravity helps fully engage hanger brackets 240 and subassemblies 210 to receiver bracket 250 and core structure 220. The geometries shown of hanger brackets 240 and receiver brackets 250 are exemplary only, and variations thereof will be apparent to those skilled in the art. In embodiments, each of core structure 220 and rear panel 121 of subassembly 210 define opposing apertures 211, 213 respectively, through which wiring to provide electrical power to light emitters (e.g., light emitters 110, FIG. 4) may be routed and into which a connector plug may be pressed, as now discussed. Upon reviewing and understanding FIGS. 6A and 6B, it will be appreciated that a subassembly 210 using the hanger bracket 240 shown requires the subassembly 210 to be in a slightly elevated position as hanger bracket 240 enters receiver bracket 250, after which subassembly 210 settles into place assisted by the force of gravity. Referring back to FIG. 5A, after subassemblies 210 are in place, cap 260 may be used to secure them in place by constraining them from moving upwards as would be required for their removal from core structure 220.

In embodiments, subassemblies 210 may have differing configurations of apertures 125 (including configurations having no apertures 125) and corresponding optical assemblies such that a given installation of pole luminaire 200 can include standard versions of optional base transition 230 and core structure 220, while configurations of luminaire subassemblies 210 may be chosen for the particular needs of the installation. Standard spacings of hanger brackets 240 and receiver brackets 250 allow this flexibility to extend not only to selections for each side of the installation, but also in the vertical sense. For example, FIG. 5A illustrates luminaire subassemblies 210-1 that extend for a certain length along core structure 220. Luminaire subassemblies 210-1 have corresponding face panels 120-1 (only one such face panel 120-1 is visible in the view of FIG. 5A). Pole luminaire 200 also includes luminaire subassemblies 210-2, 210-3 that have corresponding face panels 120-2, 120-3. Luminaire subassemblies 210-2, 210-3 are shorter than subassemblies 210-1, but their lengths add to the same length as subassemblies 210-1. In this way, subassemblies 210-1, 210-2 and 210-3 may be implemented in vertical arrangement on each face of pole luminaire 200, such that each vertical side portion 222 of core structure 220 has luminaire subassemblies 210 coupled thereto that cover its height. Similarly, in certain embodiments, a pole luminaire may couple luminaire subassemblies 210 with one or more vertical side portions 222 of core structure 220, while in other embodiments, only one or more sides of the core structure have luminaire subassemblies coupled thereto, while other sides are provided with non-illuminating subassemblies that cover the core structure to provide a uniform outward appearance.

Embodiments herein may provide substantial resistance to water and other weather related damage. Subassemblies 210, although not completely sealed, may be substantially weather resistant when assembled with optional gasket 170 and a further gasket between face panel 120 and rear shell 214. Also, as shown in FIG. 5A, a cap 260 may be installed atop core structure 220 and subassemblies 210 to provide further protection from the elements and to hold subassemblies 210 in place. Another optional gasket may also be provided to provide further weather resistance between cap 260 and core structure 220 and/or luminaire subassemblies 210. With all such gaskets in place, the main remaining locations where water might enter are apertures provided for electrical wiring in core structure 220 and in rear shell 214. These locations may be at least partially protected with a resilient connector plug, as discussed below (see FIGS. 7A, 7B).

Figure 7A:
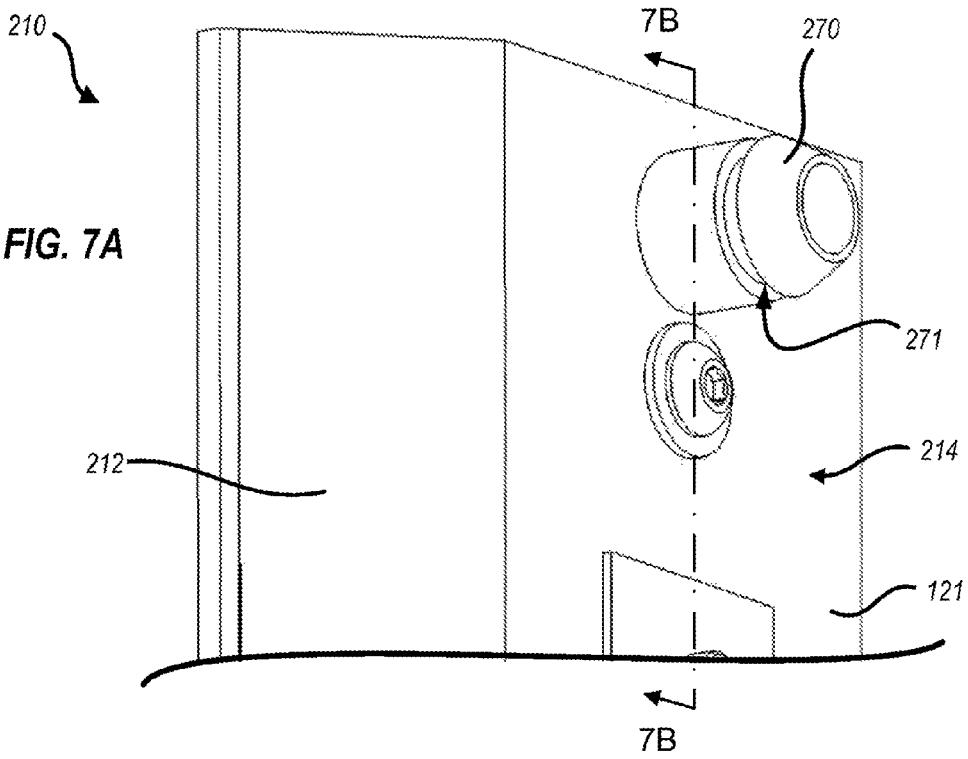
FIGS. 7A and 7B illustrate portions of a luminaire subassembly and a core structure with a connector plug that provides a water resistant connection between the core structure and the luminaire subassembly, according to an embodiment.
Figure 7B:
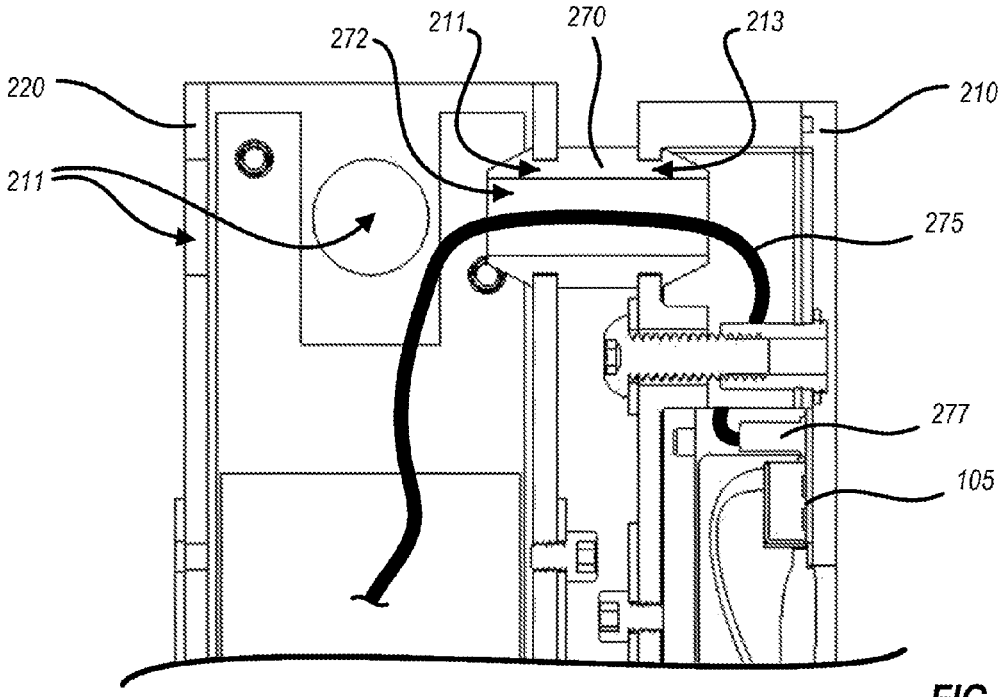

FIGS. 7A and 7B illustrate a luminaire subassembly 210 and core structure 220 with a connector plug 270 that provides a weather-resistant connection between core structure 220 and luminaire subassembly 210. FIG. 7A is an isometric view of one end of subassembly 210 in isolation with connector plug 270, while FIG. 7B is a cutaway view of the end of subassembly 210 mated to an end of core structure 220, showing connector plug 270 forming a connection between subassembly 210 and core structure 220. Connector plug 270 may be formed, for example, of rubber, silicone or other resilient material that is pressed into apertures 211, 213 (see also FIGS. 6A, 6B). Connector plug 270 may be radially symmetric and may have one or more radial grooves 271 therein that are sized such that plug 270 seats with grooves 2711 within round apertures such as apertures 211, 213. An electrical wire 275 extends from a plug 277 on PCB 105 within subassembly 210, through an aperture 272 defined by connector plug 270, and into core structure 220. Further connections of electrical wire 275 are not shown, but wire 275 may for example terminate in a connector that mates with a corresponding connector in core structure 220. Alternatively, wire 275 may terminate in a bare wire end suitable for connecting with other bare wire ends using twist-on type connectors, or for plugging into a "poke-in" type connector of an electronic driver module. Although electrical wire 275 is shown originating within subassembly 210 and extending through connector plug 270 into core structure 220, it is contemplated that a wire may similarly originate within base 60 (FIG. 1), pass through optional base transition 230, and pass through central shaft 221 of core structure 220 (FIG. 5A), then through connector plug 270, and form a connection to other wires within subassembly 210. Also, there is no limitation on the type of wire represented by electrical wire 275; for example, wire 275 may be a pair or other multiple set of wires to supply power, ground or other voltages, currents or signals to subassembly 210.

FIGS. 8A and 8B schematically illustrate a pole luminaire 350 having two curving outer faces. FIG. 8A is a cross-sectional view taken along a horizontal plane along line 8A-8A in FIG. 8B, while FIG. 8B is an isometric view of an upper portion of luminaire 350. FIG. 8A illustrates a core structure 320 that includes two substantially vertical side portions 322 arranged about an open central shaft 321. Luminaire subassemblies 310 couple with side portions 322 using mating brackets 340, which may include hanging and receiver brackets (similar to brackets 240, 250, FIGS. 5A, 6A, 6B) or any other form of mating brackets for coupling one structural member to another. Advantageously, mating brackets 340 are configured such that once wiring is in place, luminaire subassemblies 310 can couple with core structure 320 such that luminaire subassemblies 310 prevent visibility of core structure 320 from any side. Stated another way, in a cross-sectional plan view of pole luminaire 350, taken at any height above the base or base transition, core structure 320 is completely surrounded by one or more subassemblies, such as shown in FIG. 8A. At least one subassembly is a luminaire subassembly, but one or more non-illuminating subassemblies could be among those completely surrounding core structure 320. FIG. 8B shows apertures 325 defined by luminaire subassemblies 310. The principles discussed above, in which light emitters couple to a face panel of luminaire subassemblies 310, emit light toward core structure 320 and in which the light is diffused and reflected through apertures 325, can be adapted to provide suitable optical assemblies for luminaire 350. A cap 360 provides a finished look and provides weather resistance for components within core structure 320.

Figure 9:
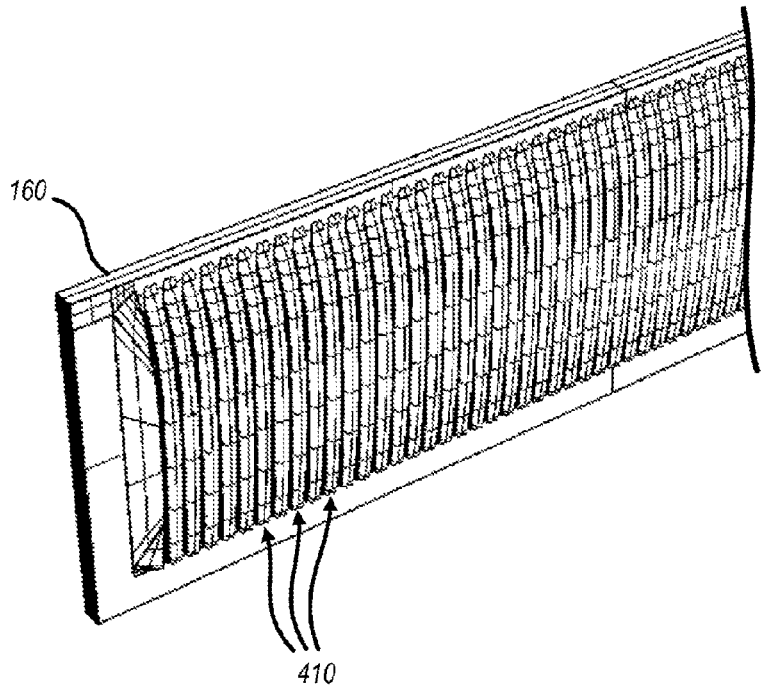
FIG. 9 is a rear view of a portion of a face plate that may couple within an aperture of a pole luminaire, showing vertical ridges therein, according to an embodiment.
Figure 10:
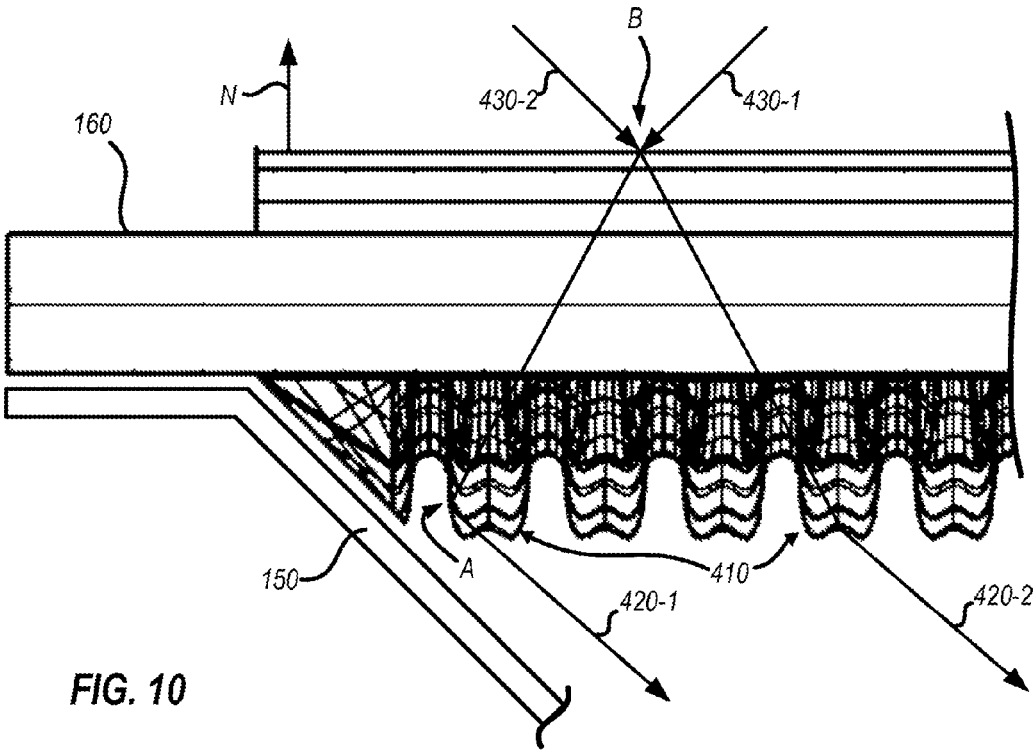
FIG. 10 is an enlarged, top plan view of a portion of the face plate of FIG. 9.

FIGS. 9 and 10 schematically illustrate certain features of face plate 160 (FIGS. 2, 3 and 4). FIG. 9 is a rear view of a portion of face plate 160, showing vertical ridges 410. Ridges 410 advantageously run vertically on the rear surface of face plate 160 such that light from light emitters, diffusers and/or a reflector of light engine 100 (see FIGS. 2, 3 and 4) is refracted and/or reflected in horizontal directions but not as much in vertical directions. This leads to several advantages. First, light from individual light emitters is blended such that a viewer does not see distracting images within apertures 125. To accomplish this blending, ridges 410 are advantageously provided at a fairly high multiple of the number of light emitters that occur along a horizontal row. For example, one particular embodiment provides two rows of eight light emitters (light emitters 110, FIG. 4) and fifty-six ridges 410 across face plate 160—a ratio of seven ridges 410 to each light emitter. Lower ratios, down to about three ridges 410 to each light emitter, are possible but may begin to provide incomplete blending of light emitters as viewed through face plate 160. Second, ridges 410 that are near horizontally outer edges of face plate 160 and apertures 125 reflect a portion of light reaching them both toward, and away from, the horizontal direction in which such portion of light reaches them, such that a viewer will not see significantly brighter or less bright regions within an aperture 125, even if light emitters 110 are concentrated near the middle of that aperture 125. This is demonstrated more fully in FIG. 10.

Figure 11:
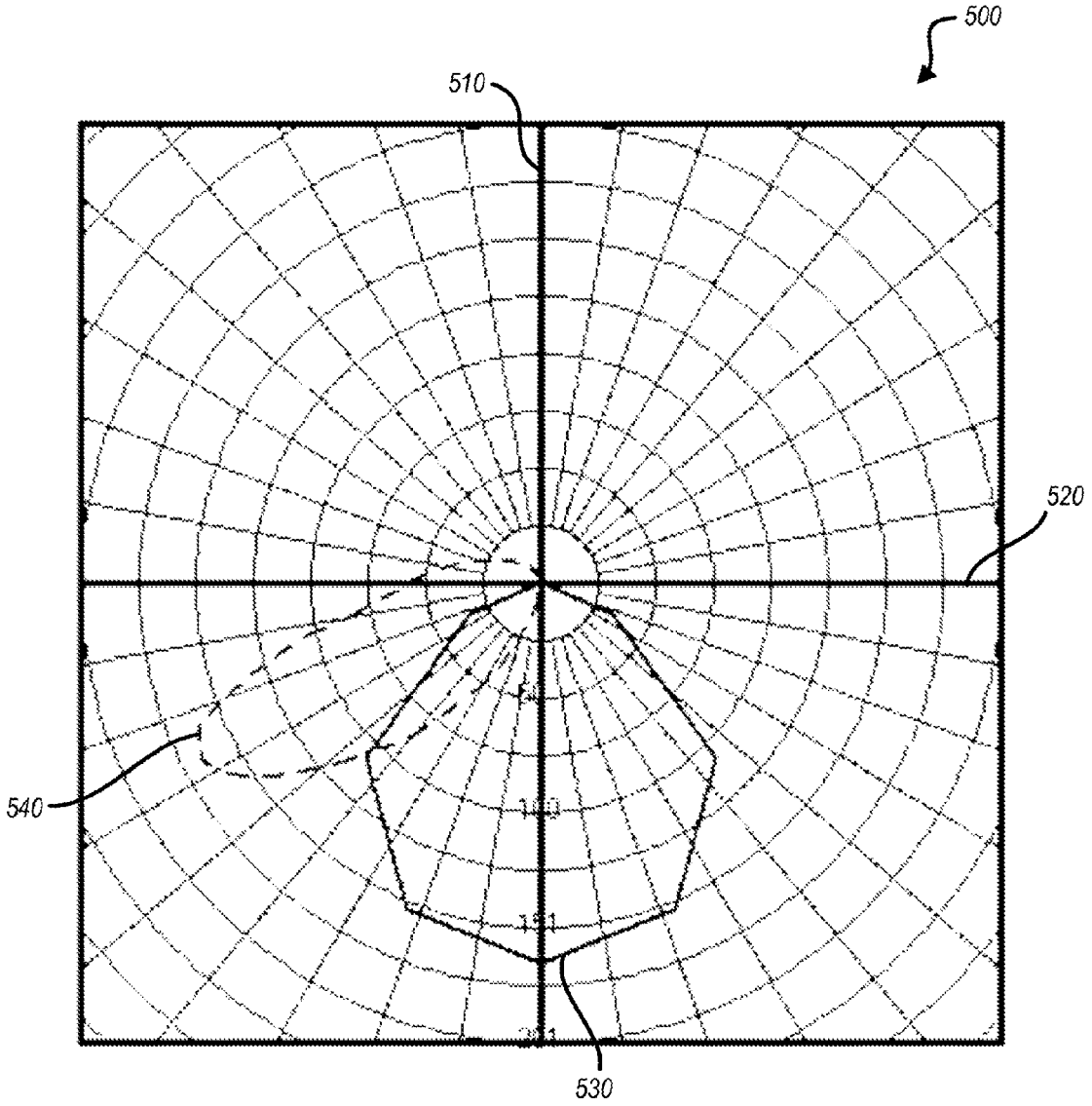
FIG. 11 shows a polar plot of photometric distributions for a single aperture of a pole luminaire, according to an embodiment.

FIG. 10 is an enlarged, top plan view of a portion of face plate 160, along with a corresponding portion of reflector 150. In order to fit within a luminaire subassembly that mates with other luminaire subassemblies to provide a four-sided pole luminaire having a sleek, tailored appearance at its corners, reflector 150 and face plate 160 are typically very thin at their edges so that the subassembly can form an angle of 45 degrees or less (for example, see FIGS. 5A and 6B showing sides 212 at such angles). It is extremely difficult to provide this and simultaneously provide light engines that can illuminate an aperture 125 that is "fully flashed," that is, exhibits bright light at all viewing angles that lie within significant extents of an associated photometric distribution, across the entire aperture 125. Referring momentarily to FIG. 11, this means that bright light will be seen across the ±50 degree, horizontal photometric distribution shown. FIG. 10 shows an arrangement of face plate 160 and reflector 150 that meet the geometric constraint at the same time as it provides light across, or nearly across, the full aperture. Consider a point B that is near the edge of the corresponding aperture. Two viewers at different viewing locations will see point B along lines 430-1 and 430-2 respectively (lines 420 and 430 are drawn as "backward ray traces" in FIG. 10; that is, the arrows provided are opposite to the direction of light propagation that would occur from the corresponding luminaire subassembly). Without vertical ridges 410, the viewer along line 430-2 might see light from light emitters, because line 430-2 lies along a direction from the light emitters to the viewer (see line 420-2), but the viewer along line 430-1 might not see light, as the direction from point B to the viewer is opposite to the direction from the light emitters to the viewer (see line 420-1). Ridges 410 provide not only significant modulation in a horizontal direction. (side-to side, in the view of FIG. 10) to blend light from light emitters that are distributed in horizontal rows, but also provide relatively planar surface portions that are close to a surface normal of the face plate (that is, having an azimuthal component that is within about 15 degrees of direction N, in FIG. 10). Point A shown in FIG. 10 is such a planar surface portion. Light that originates from a light emitter along line 420-1 reaches point A and totally internally reflects from an internal surface of one ridge 410, emerging from face plate 160 at point B along line 430-1. A different portion of light from a light emitter, traveling along line 420-2 will be refracted by another ridge 410, will also reach point B, but will then emerge along line 430-2. Thus, vertical ridges that provide planar surface portions that are nearly normal, can not only blend light from multiple light emitters, but can also reverse horizontal direction of enough of the light, that the aperture appears "fully flashed" across a wide range of viewing angles.

FIG. 11 shows a polar plot 500 of photometric distributions for a three-aperture luminaire subassembly for a pole luminaire as described herein. A horizontal distribution 530 is shown as a solid line, and a vertical distribution 540 is shown as a broken line; both reflect far field distributions of light from the luminaire subassembly being at the origin of the plot (an intersection of vertical axis 510 and horizontal axis 520). Horizontal distribution 530 illustrates the horizontal spread of light that exits the luminaire subassembly at a vertical angle at which peak light intensity is emitted by the luminaire subassembly (approximately 28 degrees downward from horizontal), thus horizontal distribution 530 is confined to areas below horizontal axis 520; that is, no light from the luminaire subassembly is directed behind the subassembly. Similarly, vertical distribution 540 illustrates the vertical spread of light that exits the luminaire subassembly in a vertical plan that is perpendicular to the apertures, thus vertical distribution 540 is confined to areas to the left of vertical axis 510. The photometric distributions show a substantially symmetric horizontal distribution with significant extents out to about 50 degrees on either side of vertical axis 510. This type of horizontal distribution is suitable for uniformly illumination all the way around a four-sided pole, that is, with similar luminaire subassemblies on all four faces of the pole, the edges of the horizontal distributions on adjacent faces will overlap somewhat. The vertical distribution is narrower and concentrated in a downward direction, peaking at about 28 degrees downward. As noted above in connection with FIG. 3, a significant majority of the vertical distribution lies below the horizontal. The major refractive and reflective elements of light engine 100 direct light only into angles that are below the horizontal; the only light that is emitted above horizontal is due to phenomena such as internal Fresnel reflections and scattering that direct very small portions of light into upward angles. Thus, there is very little light emitted outward (which may form undesirable glare) or upward (which may form undesirable light pollution).

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described, are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. A pole luminaire configured for mounting to a base and for illuminating an area adjacent to the base, comprising:

a core structure that includes:

a plurality of substantially vertical side portions that are configured to couple with and extend vertically from the base, wherein the plurality of substantially vertical side portions are disposed about an elongate, open central shaft; and one or more luminaire subassemblies that couple with the core structure, each luminaire subassembly comprising:

a housing comprising a face panel, wherein an aperture is defined in the face panel and comprises a height and a width, a face plate coupled within the aperture, and a light engine comprising one or more light emitters, wherein:

the one or more light emitters are disposed adjacent to a rear surface of the face panel within the housing, light emitted by the one or more light emitters is initially emitted toward a rear panel of the housing, and is reflected one or more times within the housing, such that the reflected light is directed through the aperture and the face plate into the area.

2. The pole luminaire as recited in claim 1, wherein the core structure comprises one or more first mating brackets that couple fixedly with the plurality of substantially vertical side portions, and the housing comprises one or more second mating brackets that couple fixedly with the housing and are configured to engage corresponding ones of the one or more first mating brackets to couple the luminaire subassembly to the core structure.

3. The pole luminaire as recited in claim 2, wherein the one or more first mating brackets are receiver brackets, each receiver bracket defining at least two slots therein, the slots being separated by a spacing, and the one or more second mating brackets are hanger brackets configured with tabs disposed at the spacing.

4. The pole luminaire as recited in claim 1, further comprising a base transition that couples directly with the base, wherein the core structure couples to the base through the base transition, and wherein at a location where the core structure couples with the base transition, the base transition comprises a substantially similar cross-section to a portion of the luminaire where the subassemblies couple with the core structure.

5. The pole luminaire as recited in claim 1, further comprising electrical wiring that extends from the base, through the open central shaft of the core structure and into each of the one or more luminaire subassemblies, to supply electrical power to the one or more light emitters of the one or more luminaire subassemblies.

6. The pole luminaire as recited in claim 1, wherein the one or more light emitters of the light engine are disposed along a horizontal row, and wherein the light engine further comprises:

a diffuser disposed such that substantially all of the light from the one or more light emitters of the light engine impinges on the diffuser and is diffused; and a reflector having a shape that is concave with respect to the aperture and the area, such that the light from the diffuser is reflected toward the aperture, the reflector being shaped and arranged such that a vertical extent of the reflector spans substantially all of the diffuser and the height of the aperture, and a horizontal extent of the reflector spans the width of the aperture.

7. The pole luminaire as recited in claim 6, the horizontal row of light emitters comprising a first horizontal row of light emitters, the light engine further comprising a second horizontal row of light emitters disposed above the first horizontal row of light emitters.

8. The pole luminaire as recited in claim 6, wherein the horizontal row of light emitters is in thermal communication with the housing.

9. The pole luminaire as recited in claim 6, wherein rays that are backward traced from the illuminated area intersect the diffuser.

10. The pole luminaire as recited in claim 6, the luminaire subassembly further comprising an inner housing shell that encloses the one or more light emitters, the diffuser and the face plate against the face panel of the housing.

11. The pole luminaire as recited in claim 10, wherein:

each of the one or more luminaire subassemblies further comprises pegs that extend from an inner surface of the face panel toward the rear panel;

the light engine further comprises a PCB upon which the one or more light emitters are mounted, the PCB defining apertures for aligning the PCB to the pegs; and the inner housing shell defines apertures for aligning the inner housing shell to the pegs.

12. The pole luminaire as recited in claim 1, further comprising a connecting plug formed of a resilient material, wherein:

the connecting plug defines an aperture therethrough, and defines radial grooves that seat within corresponding apertures defined by the core structure and the rear panel; and wiring that supplies electrical power to the light engine through the aperture defined in the connecting plug.

13. The pole luminaire as recited in claim 1, wherein the one or more luminaire subassemblies are configured to couple with the core structure so as to prevent visibility of the core structure from any exterior side of the pole luminaire.

14. The pole luminaire as recited in claim 1, further comprising a gasket disposed about a peripheral edge of the aperture between the face plate and an inner surface of the face panel of the housing, to seal the face plate to the housing.

15. The pole luminaire as recited in claim 1, wherein the face plate is a flat plate.

16. A pole luminaire configured for mounting to a base and for illuminating an area adjacent to the base, comprising:

a core structure that includes:

a plurality of substantially vertical side portions that are configured to couple with and extend vertically from the base, wherein the plurality of substantially vertical side portions are disposed about an elongate, open central shaft; and one or more luminaire subassemblies that couple with the core structure, each luminaire subassembly comprising:

a housing comprising a face panel, wherein an aperture is defined in the face panel and comprises a height and a width, a face plate coupled within the aperture, and a light engine comprising one or more light emitters, wherein:

the one or more light emitters of the light engine comprises a plurality of the light emitters arranged in a horizontal row;

light emitted by the one or more light emitters is directed through the aperture and the face plate into the area; and the face plate includes vertical ridges on an interior surface thereof, wherein the number of vertical ridges is at least three times the number of the one or more light emitters in the plurality of the light emitters.

17. The pole luminaire as recited in claim 16, wherein the number of vertical ridges is at least seven times the number of the one or more light emitters in the plurality of the light emitters.

18. The pole luminaire as recited in claim 16, wherein each of the vertical ridges forms one or more surface portions having an azimuthal component that is within fifteen degrees of a surface normal of the face plate.

19. The pole luminaire as recited in claim 1, wherein the aperture width is greater than the aperture height.

20. The pole luminaire as recited in claim 1, further comprising a cap coupled with the core structure and arranged such that when the cap is coupled with the core structure, the one or more luminaire subassemblies are not removable.

21. A pole luminaire that illuminates an illuminated area, comprising:

a base;

a core structure mounted with and extending vertically from the base;

one or more power supplies disposed within the core structure;

a plurality of subassemblies coupled with the core structure so as to prevent visibility of the core structure from any side, wherein at least one of the subassemblies comprises a luminaire subassembly comprising:

a face panel having a length along the core structure, and defining one or more apertures therein, and a rear panel, and having, associated with each of the one or more apertures:

a horizontal row of light emitters disposed within an interior space between the face panel and the rear panel, wherein the light emitters are disposed adjacent to an inner surface of the face panel along an upper edge of the corresponding aperture, and are oriented to emit light toward the interior space;

a diffuser disposed within the interior space such that substantially all of the light from the light emitters impinges on the diffuser and is diffused; and a reflector, comprising a shape that is concave with respect to the corresponding aperture and the illuminated area, such that the light from the diffuser is reflected toward the aperture;

a face plate coupled within the aperture such that the light passes through the corresponding aperture at the face plate after it is reflected by the reflector; and a rear shell, coupled with the face panel, that encloses at least the light emitters, the diffuser and the reflector within the interior space.

22. The pole luminaire as recited in claim 21, wherein at least one of the subassemblies comprises a non-illuminating subassembly.

23. The pole luminaire as recited in claim 16, wherein the core structure comprises one or more first mating brackets that couple fixedly with the plurality of substantially vertical side portions, and the housing comprises one or more second mating brackets that couple fixedly with the housing and are configured to engage corresponding ones of the one or more first mating brackets to couple the luminaire subassembly to the core structure.

* * * * *